US007124916B2

(12) United States Patent
Groh et al.

(10) Patent No.: US 7,124,916 B2
(45) Date of Patent: Oct. 24, 2006

(54) HAND-HELD PRODUCT DISPENSERS HAVING PRESSURIZED DELIVERY

(75) Inventors: David M. Groh, Marshfield, MA (US); William T. O'Connor, Londonderry, NH (US); Robert Trotta, Pembroke, MA (US)

(73) Assignee: The Gillette Company, Boston, MA (US)

( * ) Notice: Subject to any disclaimer, the term of this patent is extended or adjusted under 35 U.S.C. 154(b) by 154 days.

(21) Appl. No.: 10/968,839

(22) Filed: Oct. 19, 2004

(65) Prior Publication Data

US 2005/0178802 A1 Aug. 18, 2005

Related U.S. Application Data

(63) Continuation of application No. 10/396,896, filed on Mar. 25, 2003, now abandoned.

(51) Int. Cl.
*B65D 83/00* (2006.01)

(52) U.S. Cl. ..... 222/402.13; 222/402.15; 222/402.1; 222/182; 222/153.12

(58) Field of Classification Search .. 222/402.1–402.2, 222/402.15, 402.13, 402.23, 402.22, 402.14, 222/153.03, 153.12, 182, 380, 153.04, 153.13, 222/153.14, 389

See application file for complete search history.

(56) References Cited

U.S. PATENT DOCUMENTS

| | | | |
|---|---|---|---|
| 2,643,914 | A | 6/1953 | Reswick |
| 2,746,797 | A | 5/1956 | Remane |
| 2,879,925 | A | 3/1959 | Remane |
| 2,995,308 | A | 8/1961 | Ashkenaz |
| 3,093,857 | A | 6/1963 | Hersh |
| 3,109,656 | A | 11/1963 | Kutik |
| 3,138,331 | A | 6/1964 | Kutik |
| 3,174,659 | A | 3/1965 | Sorber et al. |
| 3,189,232 | A | 6/1965 | Joffe |
| 3,252,626 | A | 5/1966 | Belka |
| 3,426,948 | A | 2/1969 | Stirling |
| 3,429,484 | A | 2/1969 | Baldwin |
| D218,145 | S | 7/1970 | Doblin |
| 3,601,290 | A | 8/1971 | Nigro |
| 3,648,905 | A | 3/1972 | Kauder |
| 3,690,519 | A | 9/1972 | Wassilieff |
| 3,754,689 | A | 8/1973 | Blank |
| D234,074 | S | 1/1975 | Nilsson |
| 3,987,942 | A | 10/1976 | Morane et al. |

(Continued)

FOREIGN PATENT DOCUMENTS

| | | |
|---|---|---|
| EP | 0 818 401 | 1/1998 |

(Continued)

*Primary Examiner*—Frederick C. Nicolas
(74) *Attorney, Agent, or Firm*—Fish & Richardson P.C.

(57) ABSTRACT

A hand-held pressurized product dispenser including a container containing a product under pressure, a valve mechanism and base structure at the top of the container, a nozzle that moves between an unactuated position and a discharge position, and a side lever that extends along the can and is movable to move the nozzle from the unactuated position to the discharge position. The dispenser also has a dome that is rotatably connected to the base structure and surrounds the nozzle and interacts with the nozzle to cause rotation of the nozzle between a locked position and an unlocked position. The nozzle has one or more downwardly directed feet that align with solid areas of an upwardly directed surface in the locked position and that align with open areas of the base structure in the unlocked position, such that the nozzle is free to move into the discharge position.

20 Claims, 5 Drawing Sheets

U.S. PATENT DOCUMENTS

| | | | | |
|---|---|---|---|---|
| 4,077,549 | A | 3/1978 | Beard | |
| 4,111,338 | A | 9/1978 | Cheng et al. | |
| 4,157,774 | A | 6/1979 | Nicallef | |
| 4,264,037 | A | 4/1981 | Nozawa | |
| 4,324,351 | A | 4/1982 | Meshberg | |
| 4,434,914 | A | 3/1984 | Meshberg | |
| 4,636,102 | A | 1/1987 | Drake | |
| 4,733,984 | A | 3/1988 | Katsuda et al. | |
| 4,826,054 | A | 5/1989 | Frutin | |
| 5,027,986 | A | 7/1991 | Heinzal et al. | |
| 5,040,705 | A | 8/1991 | Snell | |
| 5,119,806 | A | 6/1992 | Palson et al. | |
| 5,147,075 | A | 9/1992 | Regan | |
| 5,186,364 | A | 2/1993 | Laszlo | |
| 5,348,189 | A | 9/1994 | Cater | |
| 5,379,924 | A | 1/1995 | Taylor | |
| 5,489,048 | A | 2/1996 | Stern et al. | |
| 5,524,798 | A | 6/1996 | Stern et al. | |
| 5,571,246 | A | 11/1996 | Alldredge | |
| 5,645,198 | A | 7/1997 | Stern et al. | |
| 5,655,691 | A | 8/1997 | Stern et al. | |
| 5,678,730 | A | 10/1997 | Fabek et al. | |
| 5,715,975 | A | 2/1998 | Stern et al. | |
| 5,921,446 | A | 7/1999 | Stern | |
| 5,937,874 | A | 8/1999 | Guay et al. | |
| 6,003,740 | A | 12/1999 | Castaneda, Jr. | |
| 6,016,938 | A | 1/2000 | Eichorst | |
| 6,029,862 | A | 2/2000 | Jones | |
| 6,494,349 | B1 | 12/2002 | Thompson et al. | |
| 6,685,064 | B1 | 2/2004 | Frutin | |
| 6,722,532 | B1 * | 4/2004 | Lasserre et al. | 222/137 |
| 6,758,373 | B1 | 7/2004 | Jackson | |
| 2004/0134931 | A1 * | 7/2004 | Jinbo et al. | 222/145.6 |

FOREIGN PATENT DOCUMENTS

| | | |
|---|---|---|
| FR | 2.081.931 | 12/1971 |
| FR | 2 081 931 | 12/1971 |
| GB | 1 333 832 | 10/1973 |
| JP | 7-285586 | 10/1995 |
| WO | WO 98/30469 | 7/1998 |

* cited by examiner

HAND-HELD PRODUCT DISPENSERS HAVING PRESSURIZED DELIVERY

This application is a continuation (and claims the benefit of priority under 35 U.S.C. § 120) of U.S. Ser. No. 10/396,896, filed Mar. 25, 2003 now abandoned.

TECHNICAL FIELD

The invention relates to hand-held product dispensers having pressurized delivery.

BACKGROUND

Various products have been conveniently dispensed in a pressurized form from a hand-held container such as a spray can. Typically a push button on top of the can is depressed to actuate a valve that provides an open path from the material in the container to a spray nozzle on the push button that directs the pressurized material in a direction that is perpendicular to the push button direction. This push button type of mechanism is often used for antiperspirant, deodorant and shaving cream dispensers.

Alternatively, some valves are actuated by providing a tilt (sideways push) action to an elongated tubular nozzle that directs the product along the axis of the can. Such valves are often employed in whipped cream dispensers.

In some dispensing devices, side levers have been used to activate the spray nozzle. Examples are U.S. Pat. Nos. 6,494,349; 3,252,626; 3,648,905 and 4,826,054. The '349 patent has a side lever that is located on one side of a can and is pivotally connected at the other side of the can, and a locking ring around the side of the can under the lever arm that is actuated by rotation. In the '054 patent, before rotating the locking member (which is narrower than the can and at the base of nozzle) the lever is held against side of can; after rotating, the lever moves out and can then be depressed to tilt the nozzle and eject.

SUMMARY

In one aspect, the invention features, in general, a hand-held pressurized product dispenser including a container containing a product under pressure, a valve mechanism and base structure at the top of the container, a nozzle that moves between an unactuated position and a discharge position, and a side lever that extends along the can and is movable to move the nozzle from the unactuated position to the discharge position. The nozzle is rotatably movable with respect to the base structure between a locked position in which the nozzle is prevented from moving from the unactuated position to the discharge position and an unlocked position in which the nozzle is free to move from the unactuated position to the discharge position.

In another aspect, the invention features, in general, a hand-held pressurized product dispenser including a pressurized product container, valve mechanism, base structure, nozzle and side lever. The dispenser also has a dome that is rotatably connected to the base structure and surrounds the nozzle and has an opening that is aligned with the nozzle orifice. The dome is rotatably movable between a locked position in which the nozzle is prevented from moving from the unactuated position to the discharge position and an unlocked position in which the nozzle is free to move from the unactuated position to the discharge position.

In another aspect, the invention features, in general, a hand-held pressurized product dispenser including a pressurized product container, valve mechanism, base structure, and nozzle. The base stricture has an upwardly directed surface with solid areas and one or more open areas. The nozzle has one or more downwardly directed feet and is movable with respect to the base structure between a locked position in which the feet are aligned with the solid areas of the upwardly directed surface so that said nozzle is prevented from moving from the unactuated position to the discharge position and an unlocked position in which the feet are aligned with the open areas so that the nozzle is free to move from the unactuated position to the discharge position as the feet move within the open areas.

Particular embodiments of the invention may include one or more of the following features. The container can be cylindrical about a central axis, and the nozzle can have a tubular portion that extends along the axis. The nozzle orifice can be positioned for axial discharge. The nozzle can be movable along the central axis between the unactuated position and the discharge position. The side lever can have a nozzle displacing portion that is ring-shaped and surrounds a tubular portion of the nozzle and engages an annular platform portion of the nozzle. The side lever can be pivotally connected to the base structure. The base structure can be made of a component that is separate from the container and is secured to the top of the container or can be provided as an integral part of the container. The dome can be snap-fit for rotation on the base structure. The dome and nozzle can both be rotatable about the same axis and have interacting structure (e.g., slots on one component and protrusions on the other) that causes the nozzle to rotate when the dome is rotated. The dome can have one or more stops that engage one or more stops on the base structure to limit rotation of the dome between the locked and unlocked positions. There can be an upwardly directed stops extending from the solid areas of the upwardly directed surface of the base structure and associated with each open area to prevent one of the feet from aligning with an open area when being moved to the locked position.

Embodiments of the invention may have one or more of the following advantages. Axial discharge with a side lever facilitates use by a consumer. The locking mechanism avoids accidental activation of the side lever when it is initially gripped by a user or when the dispenser is accidentally knocked over. The dome covers and protects the nozzle and portions of the side lever. The nozzle feet and associated openings provide a reliable and easily actuated locking mechanism.

Other advantages and features of the invention will be apparent from the following detailed description and from the claims.

DETAILED DESCRIPTION

Figure 1:
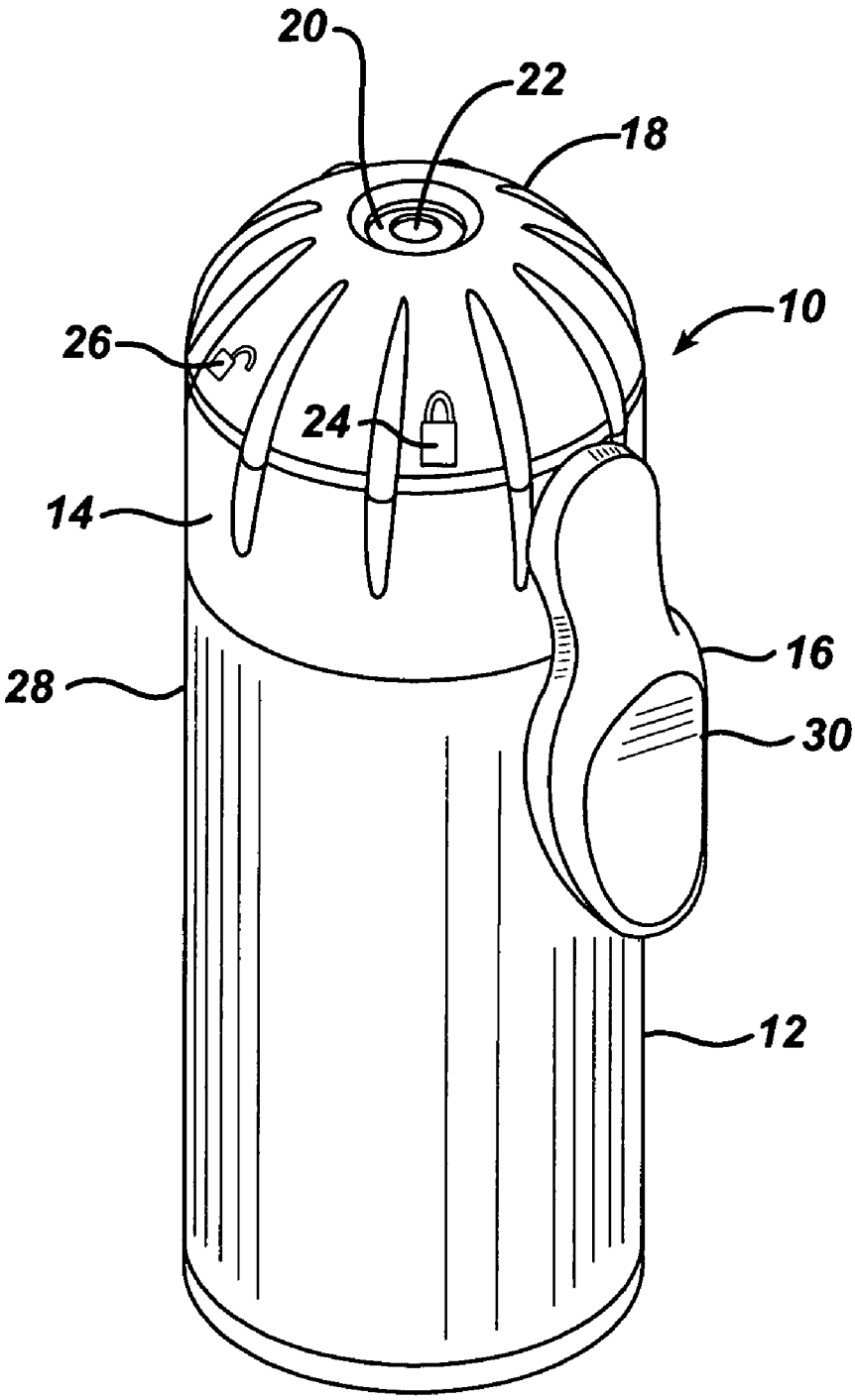
FIG. 1 is a perspective view of a hand-held pressurized product dispenser.
Figure 2:
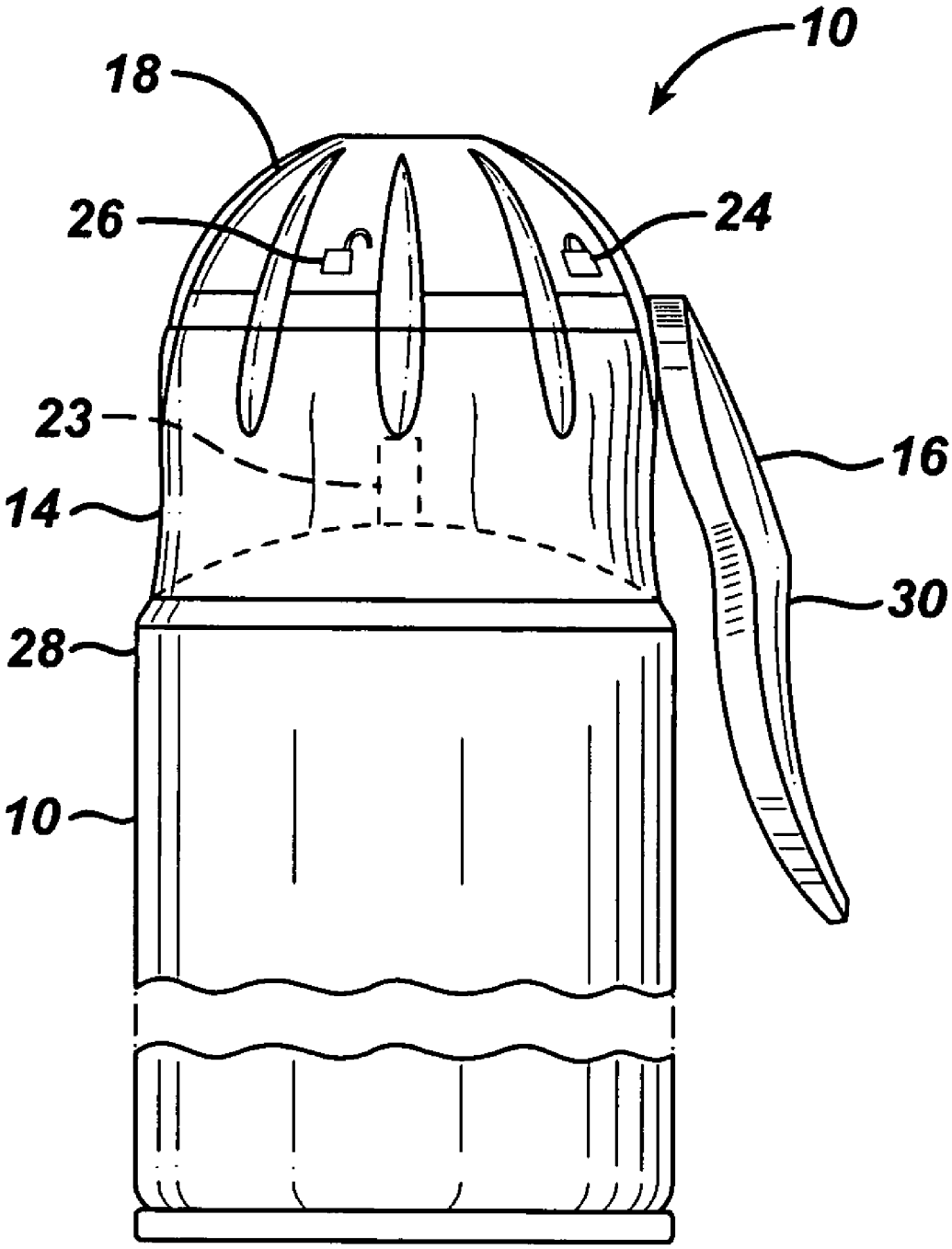
FIG. 2 is an elevation of the FIG. 1 dispenser.

Referring to FIGS. 1 and 2, dispenser 10 includes can 12 including a product under pressure, base 14 secured to the top of can 12, side lever 16, dome 18, and nozzle 20 having nozzle orifice 22 therein for discharging the product when lever 16 is activated. Can 12 includes a valve mechanism at the top that is actuated by depressing discharge tube 23 (shown in phantom in FIG. 2). Dome 18 is snap fit onto base 14. Dome 18 is rotatable between a locked position, indicated by indicia 24, in which dispenser 10 is prevented from discharging product, and an unlocked position, indicated by indicia 26, in which dispenser 10 is able to discharge product. Side lever 16 has a lever arm portion 30 that extends along the side of the can 12. In operation, the user holds dispenser 10 with hand engageable portion 28 of the can and lever arm portion 30 between the thumb and fingers.

Figure 3:
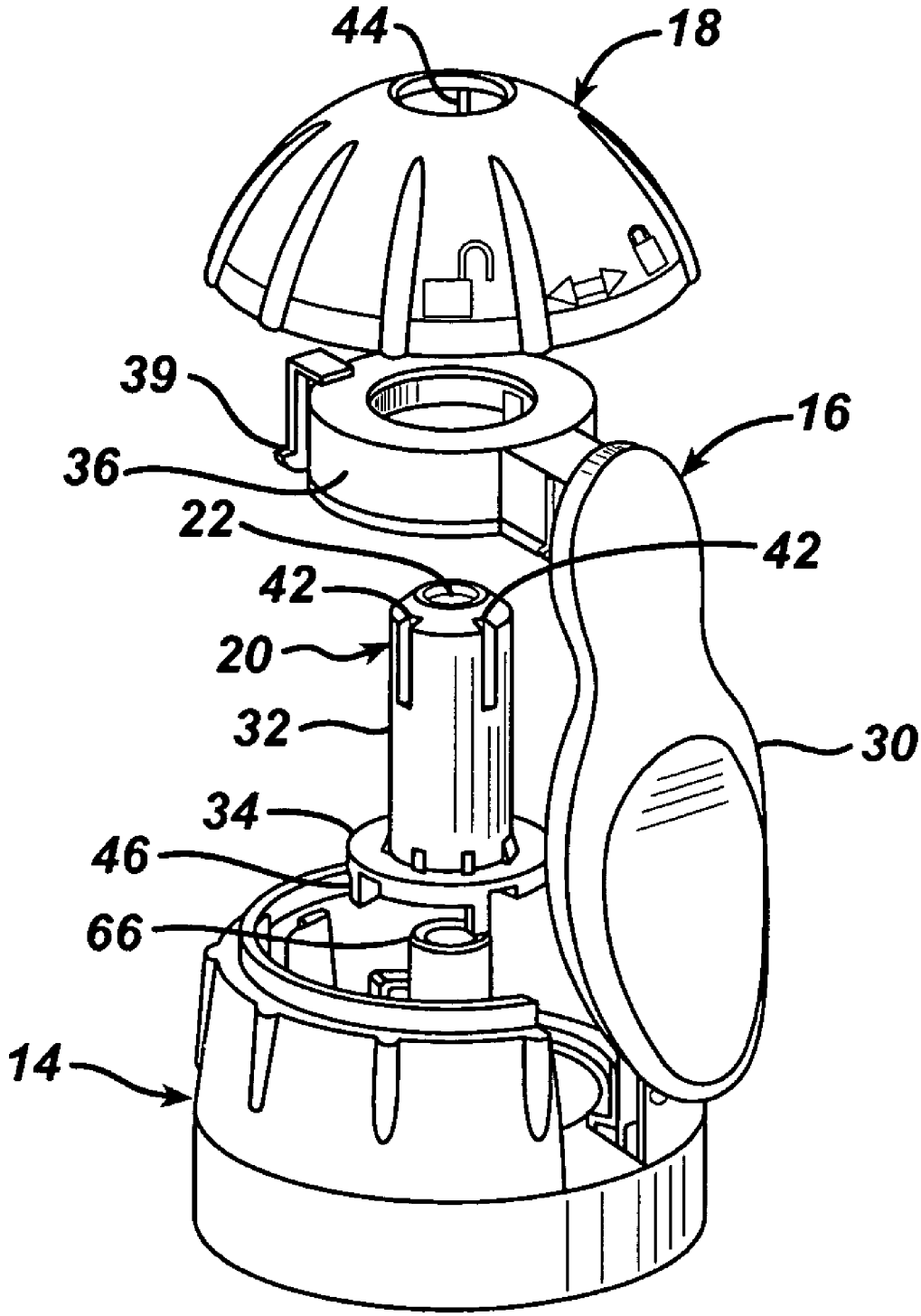
FIG. 3 is an exploded perspective view of some of the components of the FIG. 1 dispenser.
Figure 4:
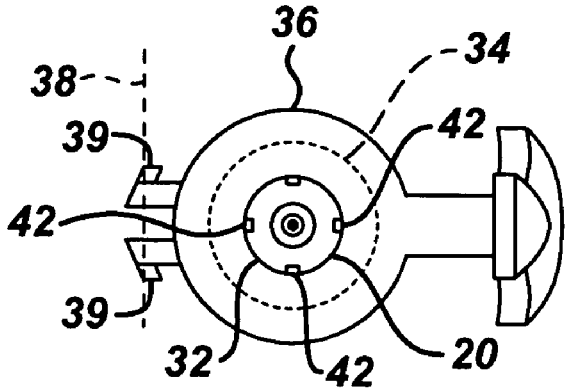
FIG. 4 is a top view of the FIG. 1 dispenser with a dome of the dispenser removed.
Figure 5:
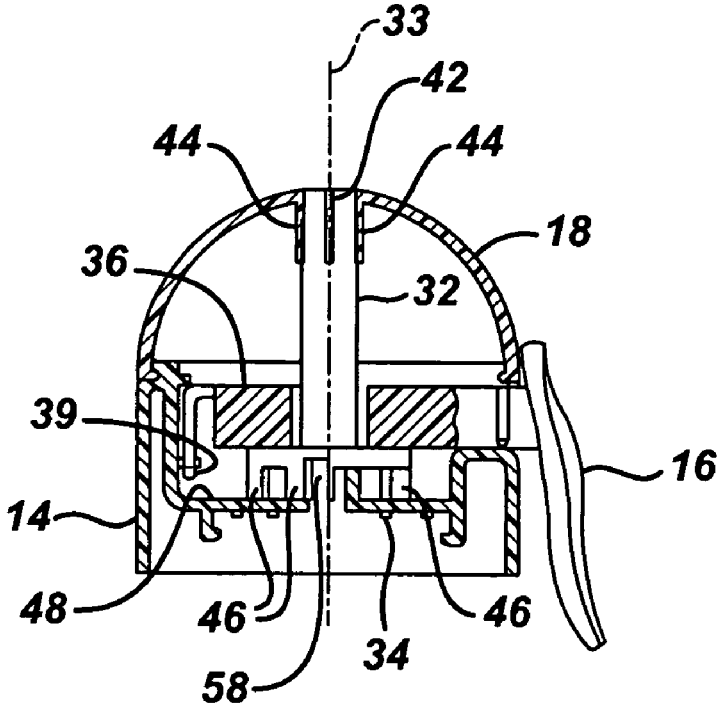
FIG. 5 is a partial vertical sectional view of the FIG. 1 dispenser.

Referring to FIGS. 3 to 5, it is seen that nozzle 20 has a tubular portion 32 that extends along axis 33 and an annular platform 34 at its base. Side lever 16 has a ring-shaped portion 36 that surrounds tubular portion 32 and rests on annular platform 34. Side lever 16 is pivotally connected to base 14 for pivoting about axis 38 via projections 39 at end 40 of side lever 16 that engage slots 41 (FIG. 7) in base 14. Nozzle 20 has an internal tube (not shown) for interacting with delivery tube 23 (FIG. 2) of the valve delivery mechanism, to depress tube 23 and direct product discharged from tube 23 to nozzle orifice 22. Base 14 includes a central, upwardly-extending tubular portion 66 that is received through an opening in platform 34 into tubular portion 32. The upper end of tubular portion 32 has four slots 42 that open outward extend a short distance along the length. Dome 18 has four inwardly directed vanes 44 (shown in FIG. 4 at sectioned portion of nozzle 20) that sit within respective slots 42. Vanes 44 interact with slots 42 to transmit rotation of dome 18 to nozzle 20.

Figure 6:
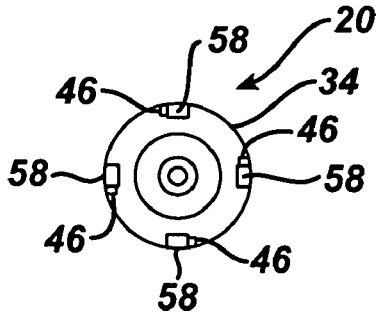
FIG. 6 is a bottom view of a nozzle of the FIG. 1 dispenser.
Figure 7:
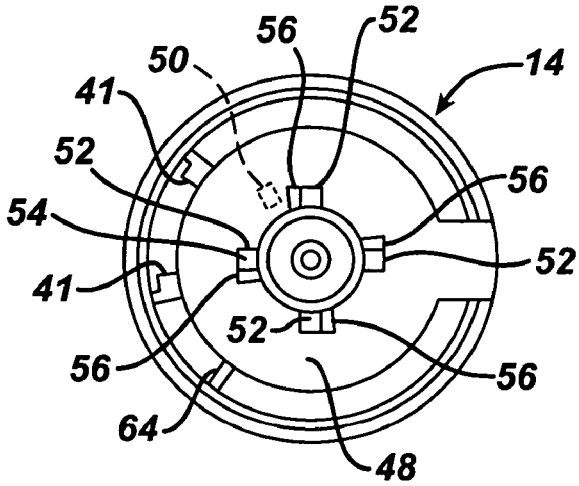
FIG. 7 is plan view of a base of the FIG. 1 dispenser.

Referring to FIGS. 5 to 7, nozzle 20 has four downwardly directed feet 46 underneath platform 34 that rest on a solid portion of upwardly directed surface 48 of base 14 when nozzle 20 is in a locked position. On FIG. 7, the position 50 for a foot 46 in the locked position is shown in phantom. Surface 48 has four openings 52 through it for receiving respective feet 46 when nozzle 20 is in the unlocked position. On FIG. 7, the position 54 for a foot 46 in the unlocked position is shown in phantom aligned with an opening 52. Four upwardly-directed projections 56 are located on one side of each opening 52 to prevent a foot 46 from moving beyond the locked position 50 into the nearby opening 52. Platform 34 has recesses 58 on one side of each foot 46 to receive projections 56 when feet 46 are aligned with and moving into openings 52.

Figure 8:
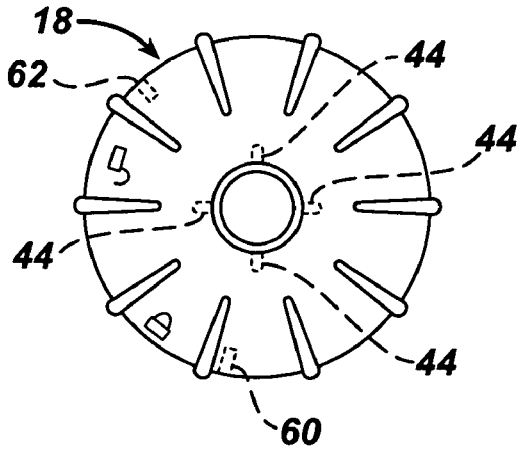
FIG. 8 is a top view of the FIG. 1 dispenser.

Referring to FIG. 8, dome 18 has two internal dome stops 60, 62 that engage with base stop 64 on base 14 to limit rotation of dome 18 between the locked and unlocked positions.

When not in use, dispenser 10 can be move to the locked position by rotating dome 18 clockwise until dome stop 60 (FIG. 8) contacts base stop 64. At the same time, nozzle 20 will be rotated, owing to interaction of vanes 44 in slots 42, until all four feet 46 of nozzle 20 reach the locked position 50 (only one position 50 shown on FIG. 7) adjacent to projections 56. Because feet 46 overlie surface 48 in this position, they prevent downward movement of nozzle 20 and accidental discharge of product. When it is desired to use dispenser 10, the user rotates dome 18 counterclockwise until dome stop 62 contacts base stop 64. At this time feet 46 are aligned with openings 52 (see position 54 for one foot 46 in FIG. 7). In this position, the spring action of the tube 23 of the valve delivery mechanism of can 12 still biases nozzle 20 upward. However, because feet are aligned with openings 52, they are free to move downward into openings 52 when lever 16 is depressed and ring-shaped portion 36 moves downward, to activate discharge of the valve delivery mechanism and axial delivery of product from nozzle orifice 22.

Other embodiments of the invention are within the scope of the appended claims.

What is claimed is:

1. A hand-held pressurized product dispenser comprising a container containing a product under pressure, said container having a top and a hand-engageable body portion, a valve mechanism at the top of said container that is operable to discharge said product from said container, said valve mechanism including a delivery tube, base structure at said top of said container, said base structure having a central upwardly extending tubular portion surrounding the delivery tube, a nozzle that has a nozzle orifice and is operably connected to said valve mechanism and is movable with respect to said container between an unactuated position and a discharge position that causes pressurized discharge of said product out of said container through said nozzle orifice, the nozzle including a lower opening for receiving the upwardly extending tubular portion, and a side lever that has a nozzle displacing portion in position to displace said nozzle from said unactuated position to said discharge position and a hand-engageable lever arm that extends along said body to a lever end and is movable with respect to said hand-engageable body portion, said nozzle being rotatably movable with respect to said base structure about an axis between a locked position in which said nozzle is prevented from moving from said unactuated position to said discharge position and an unlocked position in which said nozzle is free to move from said unactuated position to said discharge position.

2. A hand-held pressurized product dispenser comprising a container containing a product under pressure, said container having a top and a hand-engageable body portion, a valve mechanism at the top of said container that is operable to discharge said product from said container, base structure at said top of said container, a nozzle that has a nozzle orifice and is operably connected to said valve mechanism and is movable with respect to said container between an unactuated position and a discharge position that causes pressurized discharge of said product out of said container through said nozzle orifice, a side lever that has a nozzle displacing portion in position to displace said nozzle from said unactuated position to said discharge position and a hand-engageable lever arm that extends along said body to a lever end and is movable with respect to said hand-engageable body portion, and a dome that is rotatably connected to said base structure and surrounds said nozzle and has an opening that is aligned with said nozzle orifice, said dome being rotably movable between a locked position in which said nozzle is prevented from moving from said unactuated position to said discharge position and an unlocked position in which said nozzle is free to move from said unactuated position to said discharge position.

3. A hand-held pressurized product dispenser comprising a container containing a product under pressure, said container having a top and a hand-engageable body portion, a valve mechanism at the top of said container that is operable to discharge said product from said container, base structure at said top of said container, said base structure having an upwardly directed surface with solid areas surrounding at least two open areas, a nozzle that has a nozzle orifice and is operably connected to said valve mechanism and is movable with respect to said container between an unactuated position and a discharge position that causes pressurized discharge of said product out of said container through said nozzle orifice, said nozzle having at least two downwardly directed feet, and said nozzle being movable with respect to said base structure between a locked position in which said downwardly directed feet are aligned with said solid areas of said upwardly directed surface so that said nozzle is prevented from moving from said unactuated position to said discharge position and an unlocked position in which said downwardly directed feet are aligned with said open areas so that said nozzle is free to move from said unactuated position to said discharge position as said feet move within said open areas.

4. The dispenser of claim 1, 2, or 3 wherein said container is cylindrical about a central axis, and wherein said nozzle has a tubular portion that extends along said axis.

5. The dispenser of claim 1, 2, or 3 wherein said container is cylindrical about a central axis, wherein said nozzle has a tubular portion that extends along said axis, and wherein said nozzle orifice is positioned for axial discharge.

6. The dispenser of claim 1, 2, or 3 wherein said container is cylindrical about a central axis, wherein said nozzle extends along said axis, and wherein said nozzle is movable along said axis between said unactuated position and said discharge position.

7. The dispenser of claim 1 or 2 wherein said container is cylindrical about a central axis, wherein said nozzle has a tubular portion that extends along said axis and an annular platform portion, and wherein said nozzle displacing portion of said side lever is ring-shaped and surrounds said tubular portion and engages said annular platform portion of said nozzle.

8. The dispenser of claim 1 or 2 wherein said container is cylindrical about a central axis, wherein said nozzle has a tubular portion that extends along said axis and an annular platform portion, and wherein said side lever is pivotally connected to said base structure.

9. The dispenser of claim 1, 2, or 3 wherein said base structure is made of a component that is separate from said container and is secured to said top of said container.

10. The dispenser of claim 2 wherein said dome is snap-fit for rotation on said base structure.

11. The dispenser of claim 2 wherein said nozzle is rotatably movable between said locked position and said unlocked position, and said dome and nozzle both rotate about the same axis and have interacting structure that causes said nozzle to rotate when said dome is rotated.

12. The dispenser of claim 11 wherein said interacting structure includes one or more slots on one of said nozzle and said dome and one or more protrusions that engage respective said one or more slots on the other of said nozzle and said dome.

13. The dispenser of claim 12 wherein said nozzle is movable along said axis between said unactuated position and said discharge position, and wherein said slots extend parallel to said axis.

14. The dispenser of claim 2 wherein said dome has one or more stops that engage one or more stops on said base structure to limit rotation of said dome between said locked and unlocked positions.

15. The dispenser of claim 1 wherein said base structure also has an upwardly directed surface with solid areas and one or more open areas, wherein said nozzle has one or more downwardly directed feet, and wherein, when said nozzle is in said locked position, said one or more downwardly directed feet are aligned with said solid areas of said upwardly directed surface so that said nozzle is prevented from moving from said unactuated position to said discharge position, and when said nozzle is in said unlocked position, said one or more downwardly directed feet are aligned with said one or more open areas so that said nozzle is free to move from said unactuated position to said discharge position as said feet move within said open areas.

16. The dispenser of claim 2 wherein said nozzle is rotatably movable between said locked position and said unlocked position, wherein said dome and nozzle both rotate about the same axis and have interacting structure that causes said nozzle to rotate when said dome is rotated, wherein said base structure has an upwardly directed surface with solid areas and one or more open areas, wherein said nozzle has one or more downwardly directed feet, and wherein, when said nozzle is in said locked position, said one or more downwardly directed feet are aligned with said solid areas of said upwardly directed surface so that said nozzle is prevented from moving from said unactuated position to said discharge position, and when said nozzle is in said unlocked position, said one or more downwardly directed feet are aligned with said one or more open areas so that said nozzle is free to move from said unactuated position to said discharge position as said feet move within said open areas.

17. The dispenser of claim 3 wherein said nozzle is rotatably movable between said unlocked and said locked position about an axis.

18. The dispenser of claim 15, 16, or 17 wherein there are a plurality of said open areas that are angularly spaced about said axis and wherein there are a plurality of said feet that are angularly spaced about said axis.

19. The dispenser of claim 15, 16, or 17 wherein there are a plurality of said open areas that are angularly spaced about said axis and wherein there are a plurality of said feet that are angularly spaced about said axis, and wherein there is an upwardly directed stop extending from said solid areas of said upwardly directed surface and associated with each said open area to prevent one of said feet from aligning with a said open area when being moved to said locked position.

20. The dispenser of claim 1 wherein said nozzle has a tubular portion that fits over the upwardly extending tubular portion of the base.

* * * * *